US011315503B1

(12) United States Patent
Liu et al.

(10) Patent No.: US 11,315,503 B1
(45) **Date of Patent: *Apr. 26, 2022**

(54) LIQUID CRYSTAL DISPLAY PANEL AND IMAGE DISPLAY METHOD

(71) Applicant: Wistron Corporation, New Taipei (TW)

(72) Inventors: Yuanliang Liu, New Taipei (TW); Junxin Qiu, New Taipei (TW); Lixing Zhu, New Taipei (TW); Mingyue Geng, New Taipei (TW); Chih-Chou Chou, New Taipei (TW)

(73) Assignee: Wistron Corporation, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/160,413

(22) Filed: Jan. 28, 2021

(30) Foreign Application Priority Data

Dec. 11, 2020 (CN) ..... 202011448916.5

(51) Int. Cl.
*G09G 3/34* (2006.01)
*G09G 3/36* (2006.01)

(52) U.S. Cl.
CPC ..... *G09G 3/342* (2013.01); *G09G 3/36* (2013.01); *G09G 2320/0252* (2013.01);
(Continued)

(58) Field of Classification Search
CPC .. G09G 3/342; G09G 3/36; G09G 2320/0252; G09G 2320/0646; G09G 2320/064; G09G 2320/0257
See application file for complete search history.

(56) References Cited

U.S. PATENT DOCUMENTS 8,111,238 B2 * 2/2012 Park ..... G09G 3/3426 345/102
8,243,010 B2 * 8/2012 Lee ..... G09G 3/3426 345/102

(Continued)

FOREIGN PATENT DOCUMENTS

CN 101471043 7/2009
CN 201584141 9/2010

(Continued)

OTHER PUBLICATIONS

"Office Action of Taiwan Related Application, application No. 109108166", dated Feb. 26, 2021, p. 1-p. 8.

(Continued)

*Primary Examiner* — Michael J Jansen, II
(74) *Attorney, Agent, or Firm* — JCIPRNET

(57) ABSTRACT

A liquid crystal display panel is provided. The liquid crystal display panel includes a liquid crystal display panel, a backlight module and a control circuit. The control circuit is coupled to the liquid crystal display panel and the backlight module. The control circuit is configured to control the liquid crystal display panel to display a corresponding image according to image data, and control the backlight module to provide backlight to the liquid crystal display panel. The control circuit determines a turn-on time point of each of a plurality of zones of the backlight module according to a response time of the liquid crystal display panel and a writing period of at least one target display area of the liquid crystal display panel. The control circuit further determines the turn-on time length of each zone according to the image data corresponding to the grayscale data of each zone.

14 Claims, 8 Drawing Sheets

(52) U.S. Cl.
CPC ..... *G09G 2320/0257* (2013.01); *G09G 2320/064* (2013.01); *G09G 2320/0646* (2013.01)

(56) References Cited

U.S. PATENT DOCUMENTS

| | | | | |
|---|---|---|---|---|
| 8,451,211 | B2 * | 5/2013 | Yu | G09G 3/342 345/102 |
| 8,531,388 | B2 * | 9/2013 | Lee | G09G 3/3406 345/103 |
| 8,963,826 | B2 * | 2/2015 | Oda | G09G 3/32 345/102 |
| 9,019,317 | B2 * | 4/2015 | Lee | G09G 3/2022 345/690 |
| 9,299,297 | B2 * | 3/2016 | Shibamiya | G09G 3/36 |
| 9,514,690 | B2 * | 12/2016 | Kim | G09G 3/342 |
| 10,210,822 | B2 * | 2/2019 | Zhang | G09G 3/3426 |
| 10,490,137 | B2 * | 11/2019 | Fu | G09G 3/3406 |
| 11,217,132 | B2 * | 1/2022 | Wooster | G09G 3/006 |
| 2005/0083353 | A1 * | 4/2005 | Maruyama | G09G 3/3611 345/690 |
| 2009/0184917 | A1 * | 7/2009 | Park | G09G 3/3426 345/102 |
| 2009/0243993 | A1 * | 10/2009 | Kuga | G02F 1/13318 345/102 |
| 2009/0322800 | A1 * | 12/2009 | Atkins | G09G 3/3413 345/690 |
| 2010/0085374 | A1 * | 4/2010 | Lee | G09G 3/3426 345/589 |
| 2011/0096101 | A1 * | 4/2011 | Lee | G09G 3/2022 345/690 |
| 2011/0141003 | A1 * | 6/2011 | Kim | G09G 3/342 345/102 |
| 2011/0157111 | A1 * | 6/2011 | Lee | G09G 3/3406 345/205 |
| 2011/0169852 | A1 * | 7/2011 | Yu | G09G 3/342 345/589 |
| 2014/0160180 | A1 * | 6/2014 | Oda | G09G 3/32 345/690 |
| 2014/0198123 | A1 * | 7/2014 | Shibamiya | G09G 3/3426 345/589 |
| 2016/0335957 | A1 * | 11/2016 | Fu | G09G 3/36 |
| 2018/0075813 | A1 * | 3/2018 | Zhang | G09G 3/34 |
| 2020/0135074 | A1 * | 4/2020 | Wooster | G09G 3/3426 |

FOREIGN PATENT DOCUMENTS

| | | |
|---|---|---|
| CN | 103718235 | 4/2015 |
| CN | 104505055 | 2/2017 |
| CN | 106297674 | 7/2019 |
| TW | M373544 | 2/2010 |
| TW | 201125363 | 7/2011 |

OTHER PUBLICATIONS

"Office Action of Related U.S. Appl. No. 16/866,553", dated Apr. 20, 2021, pp. 1-17.
"Office Action of China Related Application No. 202010131136.1", dated Jan. 26, 2022, pp. 1-8.

* cited by examiner

LIQUID CRYSTAL DISPLAY PANEL AND IMAGE DISPLAY METHOD

CROSS-REFERENCE TO RELATED APPLICATION

This application claims the priority benefit of China application serial no. 202011448916.5, filed on Dec. 11, 2020. The entirety of the above-mentioned patent application is hereby incorporated by reference herein and made a part of this specification.

BACKGROUND

1. Technical Field

The disclosure relates to a liquid crystal display panel, and particularly relates to a liquid crystal display panel capable of performing local dimming of a backlight module.

2. Description of Related Art

As electronic games are popular all over the world, the demand for gaming monitors is also growing. Currently, there are mainly three type of display panels: twisted nematic (TN) type, in-plane Switching (IPS) type, and vertical alignment (VA) type. Among these three types, the response time of twisted nematic is the fastest (up to 1 ms) and has a higher market share in gaming displays, but its drawback is that the colors are not vivid enough and the viewing angle is poor. Lateral electric field effect LCD panels and the vertical alignment LCD panels have good colors and large viewing angles, but the disadvantage is that the response time is slow (usually 5 ms). When the content of the image changes quickly (for example, when it's a fast-moving object) while the backlight is constantly on but the response time is not fast enough, the user may see an afterimage near the aforementioned object.

Therefore, it is necessary to propose a solution for the lateral electric field effect LCD panels and the vertical alignment LCD panels to eliminate the afterimages while maintaining high contrast so as to ensure that the user sees a clear image.

SUMMARY

The disclosure provides a liquid crystal display panel capable of solving the problem of afterimage and maintaining high contrast of the display image.

The liquid crystal display panel of the disclosure includes a liquid crystal display panel, a backlight module and a control circuit. The control circuit is coupled to the liquid crystal display panel, and the backlight module. The control circuit is configured to control the liquid crystal display panel to display a corresponding image according to image data, and control the backlight module to provide backlight to the liquid crystal display panel. The control circuit determines a turn-on time point of each of multiple zones of the backlight module according to a response time of the liquid crystal display panel and a writing period of at least one target display area of the liquid crystal display panel. The control circuit further determines the turn-on time length of each of the multiple zones according to the image data corresponding to the grayscale data of each of the multiple zones.

The image display method of a liquid crystal display panel is provided. The liquid crystal display panel includes a liquid crystal display panel, a backlight module and a control circuit. The image display method includes: the control circuit configured to control the liquid crystal display panel to display a corresponding image according to image data, and control the backlight module to provide backlight to the liquid crystal display panel. The control circuit configured to determine a turn-on time point of each of multiple zones of the backlight module according to a response time of the liquid crystal display panel and a writing period of at least one target display area of the liquid crystal display panel; and the control circuit also configured to determine a turn-on time length of each of the multiple zones of the backlight module according to the image data corresponding to grayscale data of each of the multiple zones.

Based on the above, the control circuit of the liquid crystal display panel of the disclosure is capable of reducing the problem of afterimage by controlling the turn-on time of the backlight module. Further, the control circuit further determines the turn-on time length of each of the multiple zones of the backlight module according to the grayscale data of the image data. In this way, the display image can maintain high contrast.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DESCRIPTION OF THE EMBODIMENTS

Figure 1:
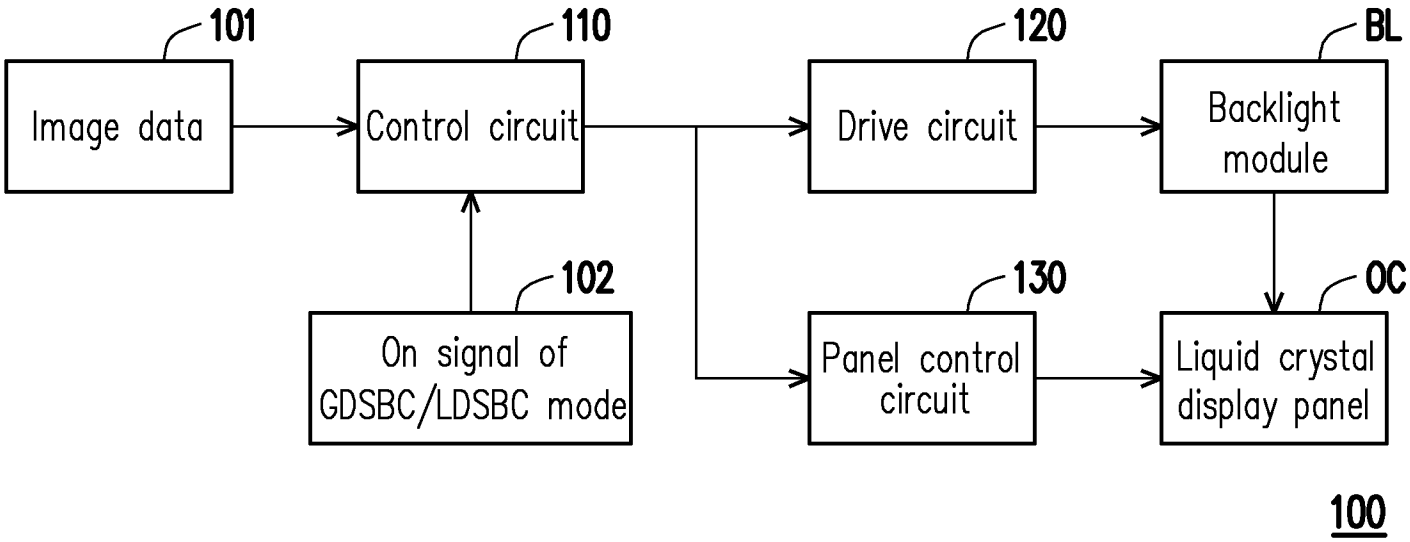
FIG. 1 is a schematic block diagram of a circuit of a liquid crystal display panel of the disclosure.

Reference will now be made in detail to the exemplary embodiments of the disclosure, examples of which are illustrated in the accompanying drawings. Wherever possible, the same reference numbers are used in the drawings and the description to refer to the same or like parts.

The disclosure proposes a global diming smart backlight control (GDSBC) technology and a local diming smart backlight control (LDSBC) technology. Correspondingly, a backlight module of the disclosure may be an overall dimming backlight module or a local dimming backlight module. A liquid crystal display panel of the disclosure can control the on and off time of the backlight module when the GDSBC mode or the LDSBC mode is turned on, such that the backlight module is turned off during a liquid crystal deflection, thereby improving the problem of afterimage of a display image. At the same time, the magnitude of an average driving current of the backlight module is controlled zone by zone so as to maintain a high contrast of the display image. In the disclosure, the display panel may be of an in-plane switching type and a vertical alignment type.

Figure 2:
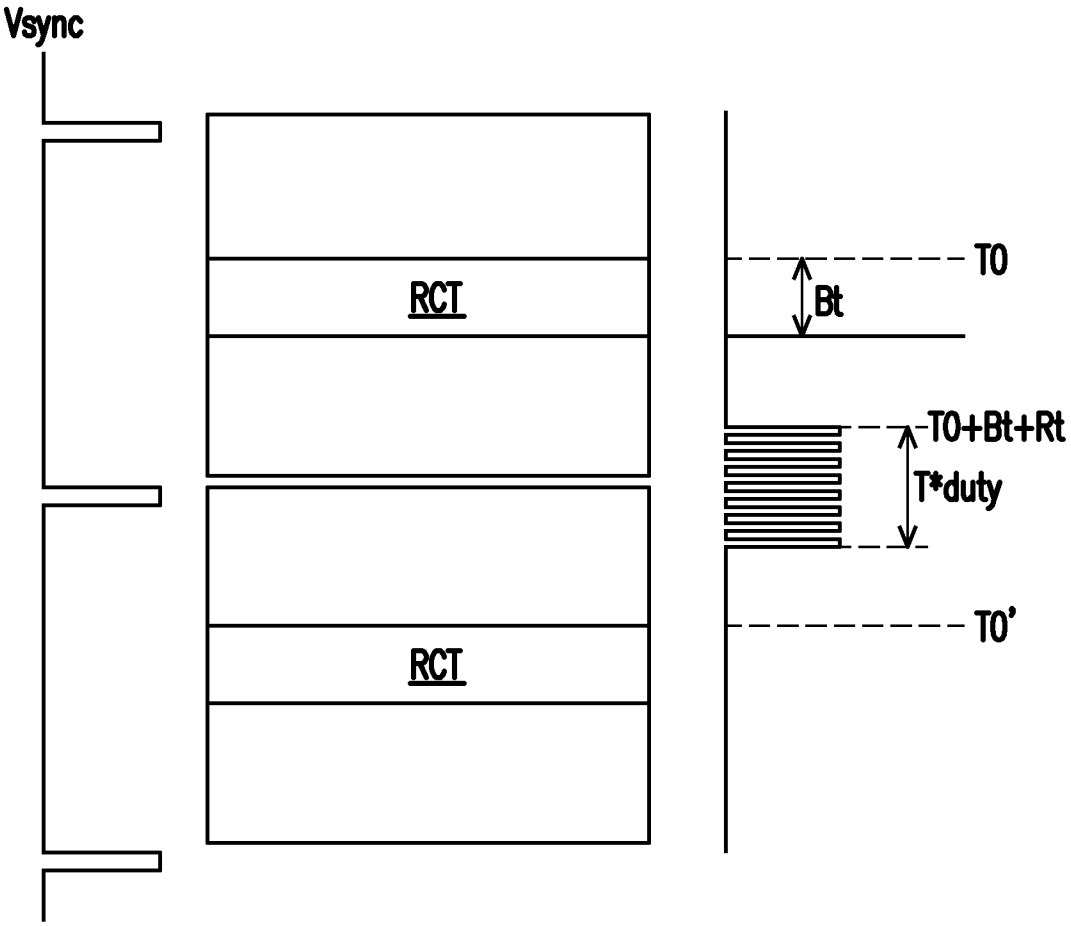
FIG. 2 is a schematic diagram of a backlight module driving in a GDSBC mode of the disclosure.

FIG. 1 is a schematic block diagram of a circuit of a liquid crystal display panel of the disclosure. Referring to FIG. 1, a liquid crystal display panel 100 includes a control circuit 110, a drive circuit 120, a panel control circuit 130, a backlight module BL, and a liquid crystal display panel OC. The control circuit 110 is configured to receive image data 101. In the case of receiving an on signal 102 of the GDSBC/LDSBC mode, the control circuit 110 may also determine a turn-on time interval (i.e. a light-emitting time) of the backlight module by controlling a switching of the light-emitting elements (such as light-emitting diodes) of the backlight module BL having a high-frequency square wave, according to a response time of a liquid crystal display panel OC and a writing period of a target display area. The high-frequency square wave may be generated based on a pulse-width modulation (PWM) signal, for example. Also, the control circuit 110 may also divide the image data 101 into multiple levels according to the luminance of the content, and then determine the magnitude of the average driving current of each zone according to the level corresponding to each zone in the backlight module BL. The drive circuit 120 at least includes a timing controller, a gate driver, and a source driver. The control circuit 110 is configured to determine a control voltage according to the image data 101, and causes changes (in response to the control voltage) in a twisting degree of the alignment of liquid crystal molecules in the liquid crystal display panel OC through the panel control circuit 130, so as to display different gray levels. With reference to FIG. 2, the following will illustrate how the control circuit 110 controls the turn-on time interval of the backlight module BL according to the response time of the liquid crystal display panel OC and the writing period of the target display area in the GDSBC mode.

FIG. 2 is a schematic diagram of a backlight module driving in a GDSBC mode of the disclosure. Please refer to both FIG. 1 and FIG. 2. T0 represents a time point at which a central display area RCT of the target display area of the liquid crystal display panel OC starts refreshing. Bt represents a time length required to refresh an entire central display area RCT. Rt represents a response time required to deflect the liquid crystal molecules of the liquid crystal display panel OC. T represents a length of a time interval between two vertical synchronization signals Vsync. In order to ensure the best display effect of the central display area RCT of the liquid crystal display panel OC, the control circuit 110 may determine the time point to turn on the backlight module BL to be T0+Bt+Rt. If T0+Bt+Rt is larger than T, it means that the backlight module BL is to be turned on during a period of displaying of a next image, and a turn-on time point is T0+Bt+Rt−T. Since the backlight needs to be turned off before the central display area RCT refreshes again (that is, before time point T0'), the relationship between the central display area RCT and a turn-on time interval T*duty (that is, duration of the square wave) of and the backlight module BL may be expressed as formula (1):

$$0+Bt+Rt+T^{*}\text{duty}=T0+T \qquad \text{Formula (1)}$$

For example, suppose that a current update rate of the liquid crystal display panel 100 is 144 Hz, and the T to update one image is approximately 6.9 ms. Also, suppose that the response time Rt of the liquid crystal display panel OC may be reduced to 5 ms from 14 ms via a drive technology, and the duty is set to 10% within a minimum luminance specification. After substituting the above-mentioned value into formula (1), a result can be obtained that the time length Bt is equal to 6.9-5-0.69, which is 1.21 ms. The time point T0 is equal to T/2−Bt/2, which is about 2.8 m, so as to ensure a clear effect of the central display area RCT.

It can be known from formula (1) that the smaller the response time Rt and the smaller the turn-on time interval T*duty, the larger range of the central display area RCT can be obtained. In other words, a size of a central display area RCT is inversely proportional to a sum of the response time Rt of the liquid crystal display panel OC and the turn-on time interval T*duty of the backlight module BL. However, continuous reduction of the response time Rt and the turn-on time interval T*duty will cause distortion of the image color and the loss of luminance, so a balance between the values must be achieved to produce the best image effect. When a luminance of the backlight module BL is larger than or equal to a specified luminance, the central display area RCT and the response time Rt may be left unadjusted. However, when the luminance of the backlight module BL is smaller than the specified luminance, the turn-on time interval T*duty of the backlight module BL may be increased by reducing the size of the central display area RCT or by increasing the drive current.

Although in the above method, the problem of afterimage can be improved, but because the turn-on time interval of the backlight module BL is reduced (compared to the situation when the backlight module BL is fully open), a maximum luminance of the display image may be reduced, resulting in a decrease in overall luminance. Also, the contrast of the display image (the ratio of the maximum luminance divided by the minimum luminance) is also reduced. In this regard, the control circuit 110 may further reduce the minimum luminance of the display image by controlling the magnitude of the average driving current of the backlight module zone by zone, so as to maintain high contrast of the display image. With reference to FIG. 3, the following will illustrate how the control the circuit 110 determines the average drive current of each zone of the backlight module BL according to the level, in the GDSBC mode.

Figure 3A:
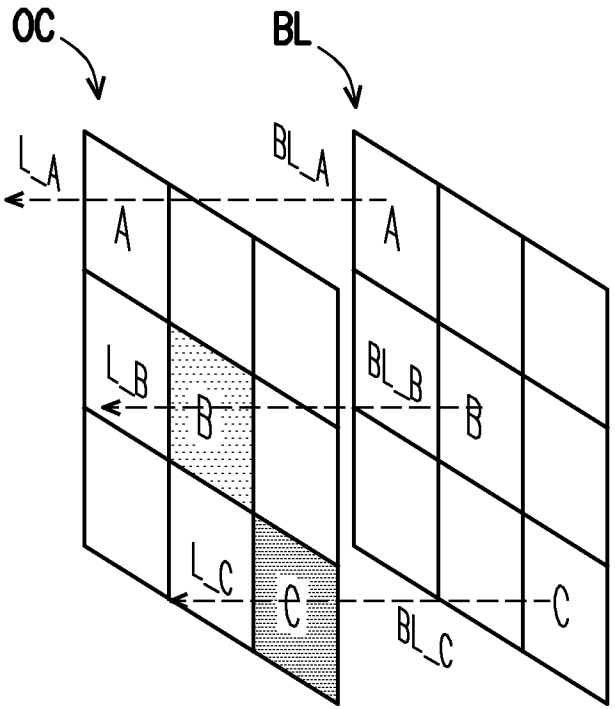
FIG. 3A is a schematic diagram of a backlight module and a liquid crystal display panel in a GDSBC mode of the disclosure.

FIG. 3A is a schematic diagram of a backlight module and a liquid crystal display panel in a GDSBC mode of the disclosure. Please refer to both FIG. 1 and FIG. 3A. By applying different control voltages to the liquid crystal molecules of the liquid crystal display panel OC, different luminance can be displayed in each zone. As may be seen from FIG. 3A, a display luminance of a zone A of the liquid crystal display panel OC is the highest (recorded as luminance L_A), a display luminance of a zone B is the second (recorded as luminance L_B), and a display luminance of a zone C is the lowest (recorded as luminance L_C). In addition to generating different display luminance by controlling the voltage, in the disclosure, overall image contrast can be further improved by reducing the minimum luminance of the display image. Specifically, the control circuit 110 performs grayscale decomposition on the received image data so as to obtain multiple levels corresponding to multiple display zones. The backlight module BL may also be divided into multiple zones, including the zone A, the zone B, and the zone C. BL_A, BL_B, and BL_C represent the luminance presented by the backlight module BL in the zone A, the zone B, and the zone C, respectively. In a light-emitting phase of the backlight module BL, the average drive current in each zone of the backlight module BL may be different from each other according to the level corresponding to each zone. In the present embodiment, the number of levels may be 36. However, the disclosure is not limited thereto. In other embodiments, the number of levels may also be 84 or even 256 (that is, directly corresponding to the grayscale value 0-255).

Figure 3B:
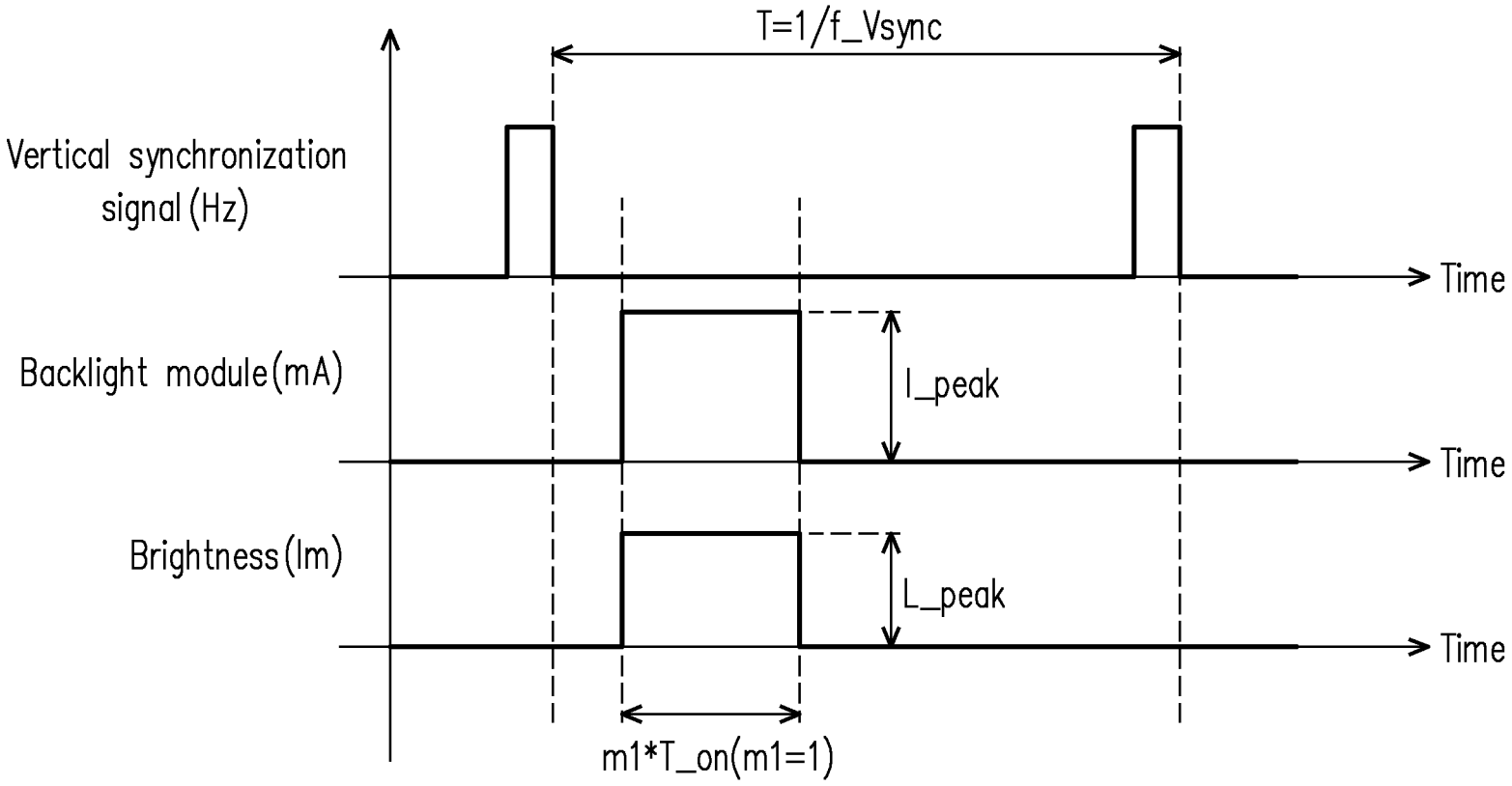
FIG. 3B is a schematic diagram showing a waveform of a drive current of a zone A in FIG. 3A.

FIG. 3B is a schematic diagram showing a waveform of a drive current of the zone A in FIG. 3A. Referring to FIG. 1, FIG. 3A and FIG. 3B at the same time, f_Vsync represents a frequency of the vertical synchronization signal, in Hz. T represents the length of the time interval between two adjacent vertical synchronization signals Vsync, which is equivalent to 1/f_Vsync, an update time of an image. i_peak represents a maximum drive current in the GDSBC mode (in mA). L_peak represents a maximum luminance displayed under drive current I_peak (in Im). T_on represents a time interval corresponding to the backlight of the zone A being turned on, and m1 represents a ratio. The control circuit 110 determines the level according to the display data corresponding the zone A. The control circuit 110 determines the ratio m1 of the zone A according to the scale. In the present embodiment, since the display luminance of the zone A is the highest, the control circuit 110 may set the ratio m1 to 1. In other words, in the entire time interval T_on, the zone A of the backlight module BL is turned on all the way with the drive current as the maximum drive current I_peak in the GDSBC mode (the average drive current is the largest).

Figure 3C:
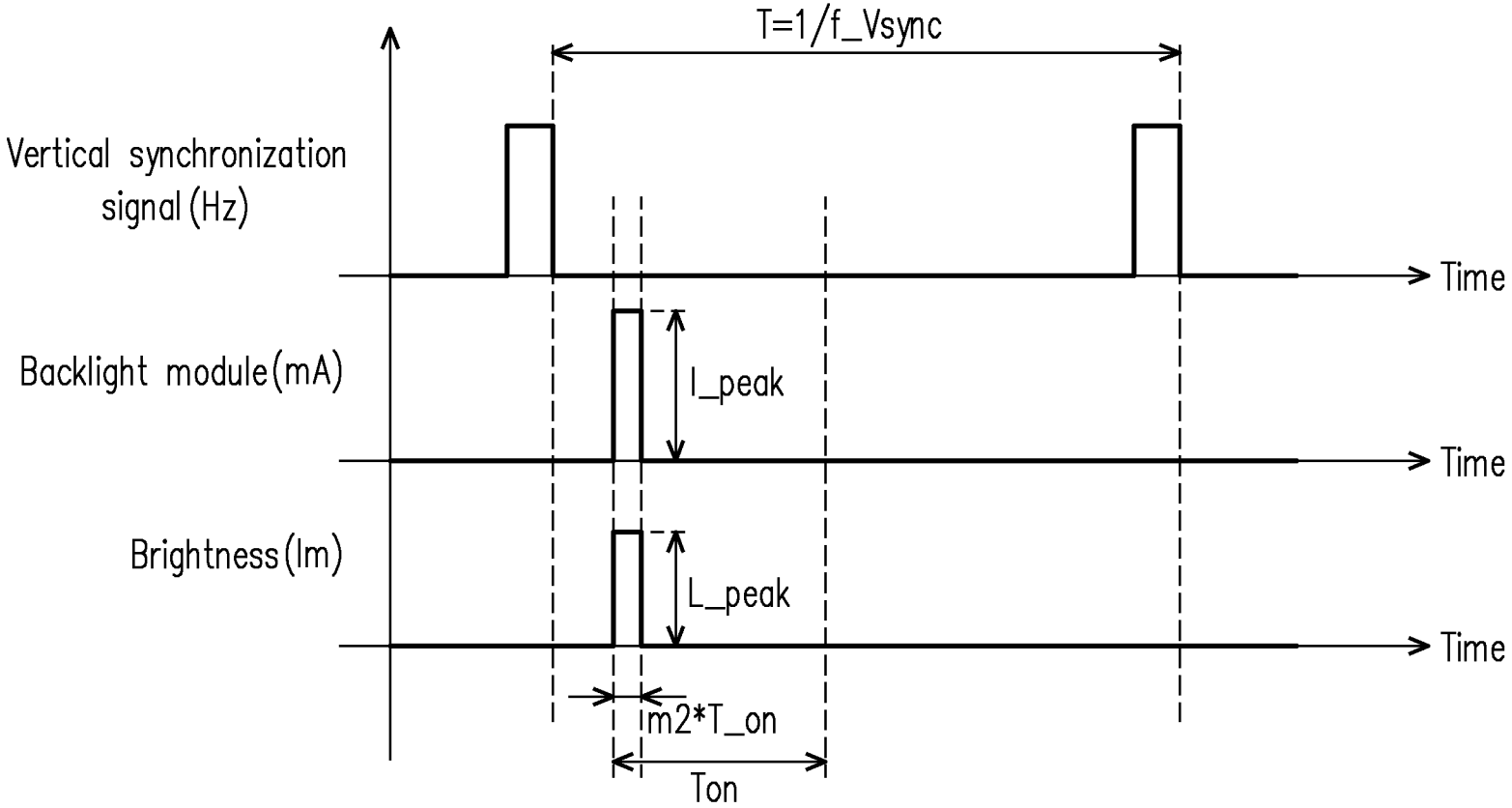
FIG. 3C is a schematic diagram showing a waveform of a drive current of a zone C in FIG. 3A.

FIG. 3C is a schematic diagram showing a waveform of a drive current of the zone C in FIG. 3A. Please refer to the descriptions of FIC. 3B for the meanings of T, Vsync, I_peak, L_peak, and T_on. It may be seen from FIG. 3A and FIG. 3C that a ratio m2 of the zone C has a lower value (for example, 0.01) compared to the ratio m1 of the zone A of the backlight module BL. In other words, in the time interval T_on, with the drive current as the maximum drive current I_peak in GDSBC mode (the average drive current is the smallest), the zone C of the backlight module BL is only turned on for a small part of the time, which makes the luminance L_C of the zone C much lower than the luminance L_A of the zone A. And, on top of affecting the luminance L_C of the zone C through a deflection angle of the liquid crystal, further reducing a drive time length of the drive current of the zone C (equivalent to adjusting the off time point of the backlight of each zone) may cause the contrast between the luminance L_C of the zone C and the luminance L_A of the zone A to be larger. Moreover, the ratio of the zone B of the backlight module BL is between the ratio between the zone A and the zone C. Therefore, the luminance L_B presented by the zone B is between the luminance of the zone A and the zone C.

The following will compare the image contrast generated by simply affecting a zone luminance through the deflection angle of the liquid crystal, and generated by controlling the turn-on time length of the drive current of each zone on top of affecting the zone luminance through the deflection angle of the liquid crystal.

K1 to K3 respectively represent luminance coefficients of the zone A to the zone C of the backlight passing through the liquid crystal display panel OC (related to the deflection angle of the liquid crystal: the whiter the image, the larger the value), where K1>K2>K3. The average drive current corresponding to the backlight of each zone of each image may be recorded as I_avg, where I_avg may be expressed by formula (2). In formula (2), f(I) represents a function of the drive current of the backlight versus time, and $Duty_{ON}$ represents the value of T_on divided by T. The average luminance generated corresponding to each zone of each image may be recorded as L_avg, where the average luminance L_avg may be expressed by formula (3). In formula (3), f(L) represents a function of the zone luminance versus time. Referring to formula (4), the relationship between the drive current of the zone and the zone luminance within a certain temperature range may be recorded as a.

$$I_{_avg} = \frac{1}{T} * \int_0^T f(I)dt = Duty_{ON} * \text{I_peak} \quad \text{Formula (2)}$$

$$L_{_avg} = \frac{1}{T} * \int_0^T f(L)dt = Duty_{ON} * \text{L_peak} \quad \text{Formula (3)}$$

$$L_{_peak} = a * I_{_peak} \quad \text{Formula (4)}$$

The luminance L_A of the zone A may be expressed as formula (5). The luminance L_C of the zone C may be expressed as formula (6). I_avg A and I_avg C respectively represent the average drive current of the zone A and the zone B of the liquid crystal display panel OC. L_peak_A and L_peak_C represent the average luminance of the zone A and the zone B, respectively. On the premise that the zone luminance is affected only by the deflection angle of the liquid crystal, the contrast between the luminance of the zone A and the luminance of the zone C of the liquid crystal display panel OC (the ratio of the two is equivalent to the contrast of the display image) may be expressed as the formula (7), which is the ratio of K1 to K3.

$$\text{L_A} = \text{L_avg_A} = \text{Duty_on} * \text{L_peak_A} * K1 = \text{Duty_on} * a * \text{I_peak_A} * K1 \quad \text{Formula (5)}$$

$$\text{L_C} = \text{L_avg_C} = \text{Duty_on} * \text{L_peak_C} * K3 = \text{Duty_on} * a * \text{I_peak_C} * K3 \quad \text{Formula (6)}$$

$$\frac{L_{_A}}{L_{_C}} = \frac{Duty_{ON} * a * \text{I_peak_A} * K1}{Duty_{ON} * a * \text{I_peak_C} * K3} \quad \text{Formula (7)}$$

On the other hand, on the premise that the turn-on time length of the drive current of each zone is further controlled on top of the affecting the zone luminance by the deflection angle of the liquid crystal, the luminance of the zone A and the luminance of the zone C of the liquid crystal display panel OC may be respectively expressed as formula (8) (the ratio m1 being imported) and formula (9) (the ratio m2 being imported). In addition, the contrast between the luminance of the zone A and the luminance of the zone C of the liquid crystal display panel OC (equivalent to the contrast of the display image) may be expressed as formula (10). When m1 is equal to 1 and m2 is equal to 0.01, the image contrast calculated by formula (10) is significantly better than the image contrast calculated by formula (7).

$$\text{L_A} = \text{L_avg_A} = \text{Duty_on} * m1 * a * \text{I_peak_A} * K1 \quad \text{Formula (8)}$$

$$\text{L_C} = \text{L_avg_C} = \text{Duty_on} * m2 * a * \text{I_peak_C} * K3 \quad \text{Formula (9)}$$

$$\frac{L_{_A}}{L_{_C}} = \frac{Duty_{ON} * m1 * a * \text{I_peak_A} * K1}{Duty_{ON} * m2 * a * \text{I_peak_C} * K3} = \left(\frac{m1}{m2}\right) * \left(\frac{K1}{K3}\right) \quad \text{Formula (10)}$$

It may be known from the above content that in the GDSBC mode of the disclosure, all zones of the backlight module BL will still be driven by the same current intensity at the same time point. However, depending on the level corresponding to each zone in the backlight module BL, the time length that each zone of the backlight module BL is turned on is also different. In this way, the difference in the luminance of the corresponding zone of the liquid crystal display panel OC may be strengthened, such that the high contrast of the image can be maintained while improving the problem of afterimage of the display image.

Compared with the GDSBC mode in which the display effect of the central display area RCT can be ensured, in the LDSBC mode, the overall image seen by the user can be ensured to be the clearest. Different from the GDSBC mode in which the entire backlight module BL is driven at the same time point, in the LDSBC mode, a time-sharing method is employed to sequentially drive multiple columns of the backlight module BL.

The minimum number of columns of the aforementioned backlight module BL may be calculated by formula (11). In formula (11), N is a natural number, indicating the number of columns distinguished by the backlight module BL. T represents the update time of an image, for example, 6.9 ms. The duty is based on the minimum luminance specification, for example, 30%. The response time Rt represents the response time of the liquid crystal display panel OC, which is 5 ms, for example. In the case where T, the duty, and the response time Rt have been determined, the minimum value of N may be calculated as 5 through formula (11). Therefore, in the present embodiment, the backlight module BL is divided into five light-emitting areas (L1 to L5), and each column is turned on in sequence.

$$N > \frac{T + T * \text{duty}}{T - Rt} \qquad \text{Formula (11)}$$

Further, the control circuit 110 may also divide the image data 101 into multiple levels according to the content, and then determine the magnitude of the average drive current of each zone according to the level corresponding to the multiple zones in each column of the backlight module BL. By controlling the magnitude of the average drive current of each zone of the backlight module BL zone by zone, the minimum luminance of the display image may be further reduced to maintain high contrast of the display image.

Figure 4A:
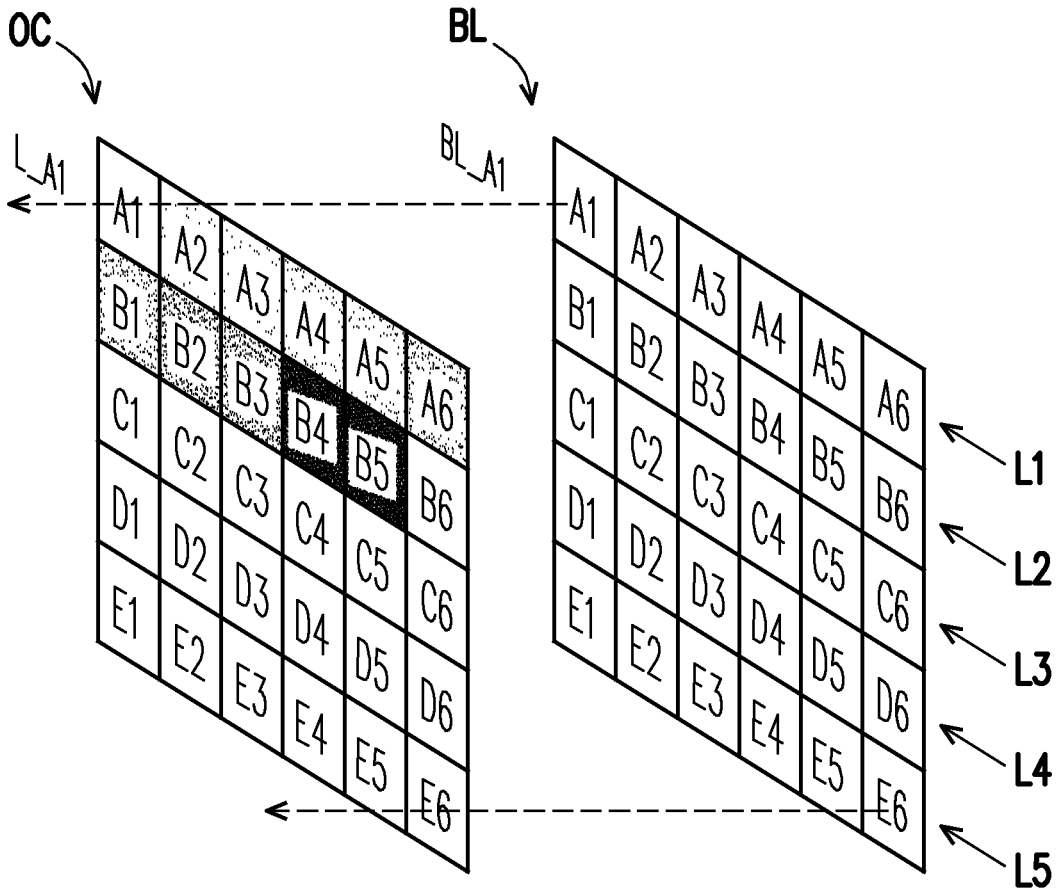
FIG. 4A is a schematic diagram of a backlight module and a liquid crystal display panel in a LDSBC mode of the disclosure.
Figure 4B:
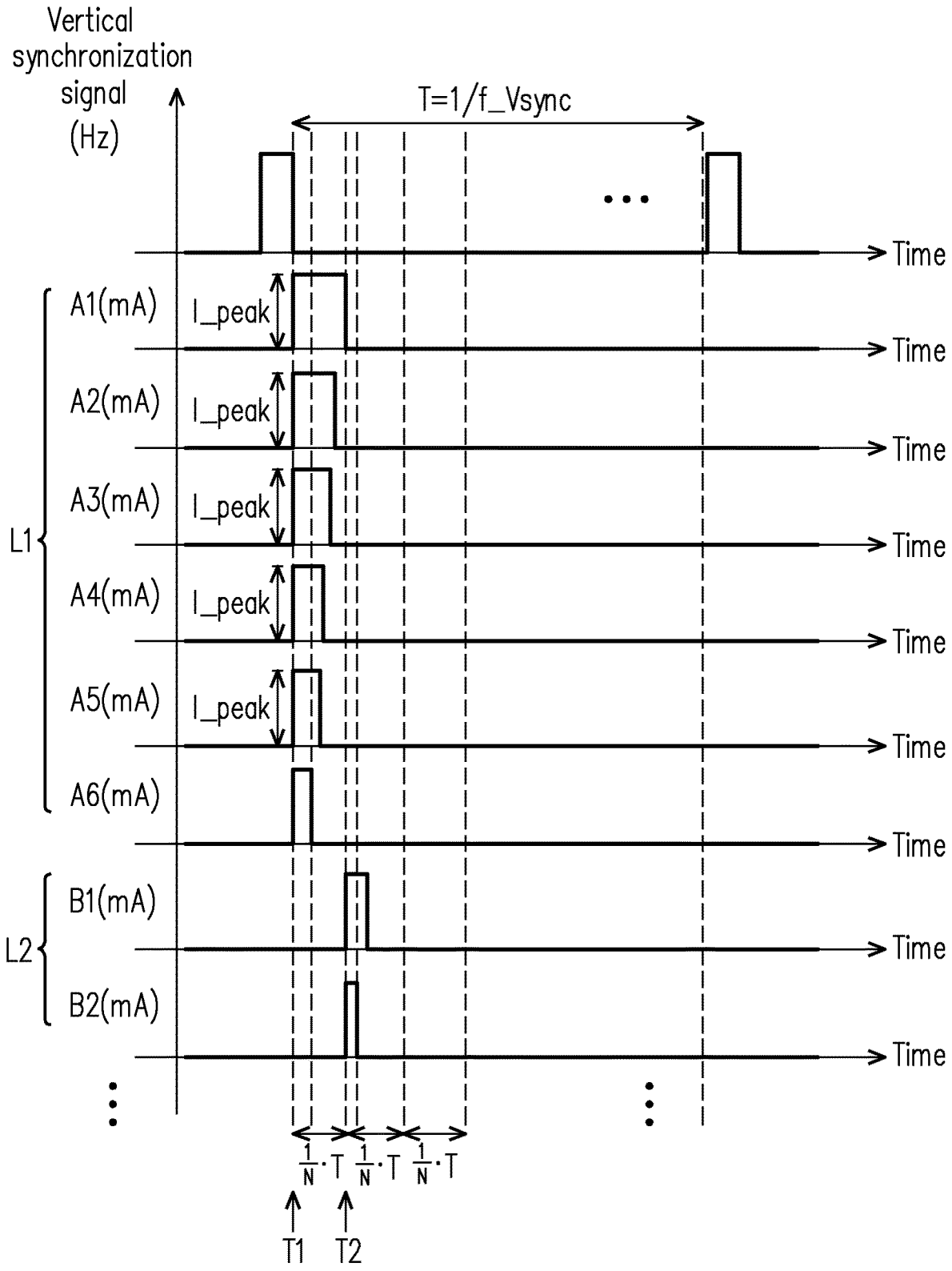
FIG. 4B is a schematic diagram showing a waveform of a drive current of each zone of a backlight module BL in FIG. 4A.

FIG. 4A is a schematic diagram of a backlight module and a liquid crystal display panel in a LDSBC mode of the disclosure. FIG. 4B is a schematic diagram showing a waveform of a drive current of each zone of a backlight module BL in FIG. 4A. Referring to FIG. 1, FIG. 4A and FIG. 4B at the same time, the meanings of T, Vsync, I_peak, L_peak, and T_on can be referred to in the description of FIG. 3B, and will not be repeated here. The backlight module BL may be divided into multiple light-emitting areas L1 to L6 in a horizontal scanning direction.

Moreover, the liquid crystal display panel OC and the backlight module BL may be correspondingly divided into zones A1 to A6 located in the light-emitting area L1, zones B1 to B6 located in the light-emitting area L2, . . . and zone E1 to E6 located in the light-emitting area L5. In addition, the luminance generated by a zone A1 of the backlight module BL is recorded as BL_A1, the luminance generated by the zone A1 of the liquid crystal display panel OC is recorded as L_A1, and the luminance generated by the rest of the zones may be deduced in this way.

A scanning sequence of the liquid crystal display panel OC may be preset so as to scan from top to bottom corresponding to each light-emitting area. When the liquid crystal molecules in the target display area corresponding to the light-emitting area L1 are completely deflected, the control circuit 110 simultaneously lights up each zone of the light-emitting area L1 of the backlight module BL at a first time point by loading the high-frequency square wave. Moreover, the control circuit 110 controls the turn-on time length of the backlight of each zone of the light-emitting area L1 according to the level corresponding to each zone of the light-emitting area L1. Then, when the liquid crystal molecules of the target display area corresponding to the light-emitting area L2 are completely deflected, the control circuit 110 lights up each zone of the light-emitting area L2 of the backlight module BL at a second time point. Moreover, the control circuit 110 controls the turn-on time length of the backlight of each zone of the light-emitting area L2 according to the level corresponding to each zone of the light-emitting area L2. The rest of the light-emitting area of the backlight module BL may be light up in this way. By lighting up the light-emitting areas L1 to L5 of the backlight module BL one by one, the afterimage caused by slow deflection of the liquid crystal molecules may be eliminated, and the image that the user sees is clear.

It may be seen from FIG. 4A that from the zone A1 to a zone B5, the display luminance gradually changes from the brightest (white) to the darkest (black). Please refer to both FIG. 4A and FIG. 4B. Taking the zone A1 to the zone B5 as an example, the zones A1 to A6 located in the light-emitting area L1 will light up at the same time point T1. The turn-on time length of the backlight is A1>A2> . . . A6. Then, the zones B1 to B6 located in the light-emitting area L2 will light up at the same time point T2. The turn-on time length of the backlight is B1>B2> . . . >B5, and the turn-on time length of the backlight of the zone B1 is shorter than the turn-on time length of the backlight of the zone A6. The turn-on time length of the backlight of any zone of any light-emitting area may be (1/N)*T at maximum. The control circuit 110 may calculate the turn-on time length of each zone by setting the ratio. The control circuit 110 may set a ratio m_A1 of the brightest zone A1 to 1; that is, the turn-on time length of the zone A1 is a maximum value (1/N)*t*1. A ratio m_B5 of the darkest zone B5 is 0.01; that is, the turn-on time length of the zone A1 is a minimum value (1/N)*t*0.01. The ratios of the zone A2 to the zone A6 and the zone B1 to the zone B4 decrease in order between 1 and 0.01.

On the premise of further controlling the turn-on time length of the drive current of each zone on top of affecting the zone luminance by the deflection angle of the liquid crystal, the luminance L_A1 of the zone A1 and the luminance L_B5 of the zone B5 may be expressed as formula (12) (ratio m_A1 being imported) and formula (13) (ratio m_B5 being imported), respectively. N is the number of light-emitting areas distinguished by the backlight module BL. In the present embodiment, N is equal to 5. T represents a length of a time interval between two vertical synchronization signals Vsync. m_A1 and m_B5 respectively represent the ratios of the zone A1 and the zone B5. i_peak represents the maximum drive current in the LDSBC mode (in mA). K_A1 and K_B5 respectively represent luminance coefficients of the backlight passing through the zones A1 and B5 (related to the deflection angle of the liquid crystal: the whiter the display image, the larger the value), where K_A1>K_B5.

$$L_A1 = \frac{1}{N} * T * m_A1 * L_peak * K_A1 \quad \text{Formula (12)}$$

$$L_B5 = \frac{1}{N} * T * m_B5 * L_peak * K_B5 \quad \text{Formula (13)}$$

The contrast between the luminance of the zone A1 and the luminance of the zone B5 (equivalent to the contrast of the display image) may be expressed as formula (14). Compared to the method of simply affecting the zone luminance through the deflection angle of the liquid crystal (i.e. please refer to formula (15) for the case where the ratio m_A1 and the ratio m_B5 are not imported), the contrast of the display image in the LDSBC mode of the disclosure is significantly improved. Assuming that the ratio m_A1 is equal to 1 and the ratio m_B5 is equal to 0.01, the image contrast calculated by formula (14) is 100 times the image contrast calculated by formula (15).

$$\frac{L_{A1}}{L_{B5}} = \frac{m_A1}{m_B5} * \frac{K_A1}{K_B5} \quad \text{Formula (14)}$$

$$\frac{L_{A1}}{L_{B5}} = \frac{K_A1}{K_B5} \quad \text{Formula (15)}$$

Figure 5:
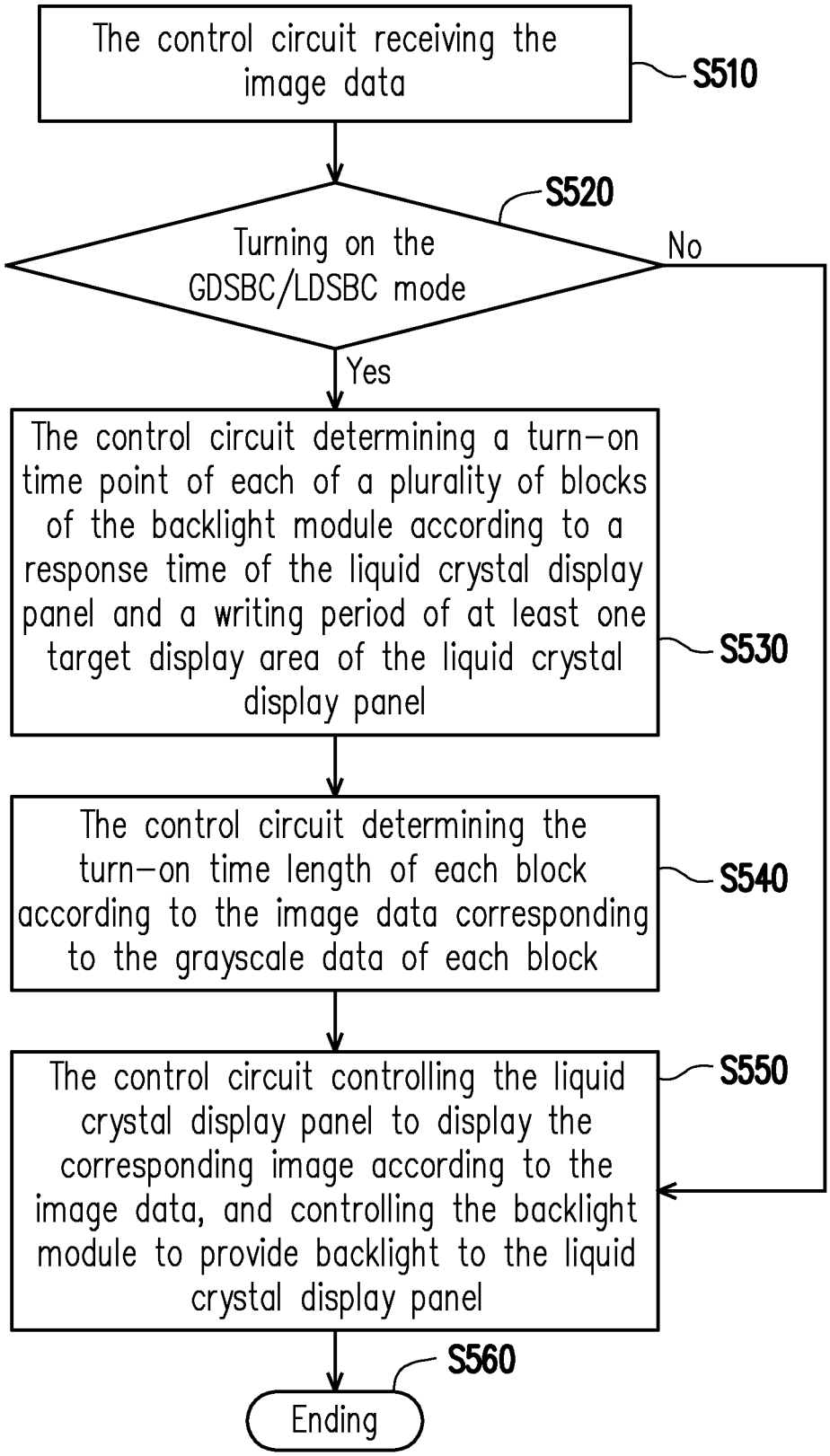
FIG. 5 shows a step flow chart of the image display method of the disclosure.

FIG. 5 shows a step flow chart of the image display method of the disclosure. Please refer to both FIG. 1 and FIG. 5. First, the control circuit 110 receives the image data 101 (step S510). Then, whether to proceed step S530 or step S550 is determined according to whether the GDSBC/LDSBC mode (step S520) is turned on. In step S530, the control circuit 110 determines the turn-on time point of the image corresponding to each of the multiple zones of the backlight module BL according to the response time of the liquid crystal display panel OC and the writing period of at least one target display area of the liquid crystal display panel OC. In step S540, the control circuit 110 determines the turn-on time length of each of the multiple zones according to the image data 101 corresponding to the grayscale data of each of the multiple zones. In step S550, the control circuit 110 controls the liquid crystal display panel OC to display the corresponding image according to the image data 101, and controls the backlight module BL to provide backlight to the liquid crystal display panel OC. In step S560, the program ends.

In summary, the control circuit of the disclosure reduces the problem of afterimage by controlling the turn-on time point of the backlight module in the GDSBC/LDSBC mode.

Further, the control circuit further determines the turn-on time length of each of the multiple zones of the backlight module according to the grayscale data of the image data. Specifically, by reducing the turn-on time length of the zone having a low grayscale value (down to 0, which is black) corresponding to the image data, the backlight luminance of the area may be reduced, thereby significantly increasing the overall contrast of the image.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. A liquid crystal display panel, comprising:

a liquid crystal display panel;

a backlight module; and a control circuit, coupled to the liquid crystal display panel and the backlight module, the control circuit configured to control the liquid crystal display panel so as to display a corresponding image according to image data, and to control the backlight module so as to provide a backlight to the liquid crystal display panel;

wherein the control circuit determines a turn-on time point of each of a plurality of zones of the backlight module according to a response time of the liquid crystal display panel and a writing period of at least one target display area of the liquid crystal display panel, wherein, the control circuit also determines a turn-on time length of each of the plurality of zones according to the image data corresponding to a grayscale data of each of the plurality of zones, wherein when a luminance of the backlight module is smaller than a specified luminance, the control circuit reduces a size of a central display area of the target display area so as to increase the turn-on time length of the backlight module.

2. The liquid crystal display panel as described in claim 1, wherein the backlight module is a global dimming backlight module, the control circuit controls each of the plurality of zones of the backlight module to be turned on simultaneously, and the control circuit also determines a turn-off time point of the backlight module in each of the plurality of zones according to the image data corresponding to the grayscale data of each of the plurality of zones.

3. The liquid crystal display panel as described in claim 2, wherein the control circuit is also configured to determine a level corresponding to each of the plurality of zones according to the image data corresponding to the grayscale data of each of the plurality of zones, and to determine a corresponding ratio according to the level of each of the plurality of zones, so as to calculate the turn-on time length of each of the plurality of zones according to the ratio.

4. The liquid crystal display panel as described in claim 3, wherein the ratio is a value smaller than or equal to 1, and larger than 0.

5. The liquid crystal display panel as described in claim 1, wherein the backlight module is local dimming backlight module, the local dimming backlight module is divided into a plurality of light-emitting areas along a horizontal scanning direction, the local dimming backlight module determines the turn-on time point of each of the plurality of light-emitting areas according to the response time of the liquid crystal display panel and the plurality of writing periods of the plurality of target display areas of the liquid crystal display panel, and separates the turn-on time points from each other.

6. The liquid crystal display panel as described in claim 5, wherein each of the plurality of light-emitting areas is divided into the plurality of zones, the control circuit is also configured to determine a level corresponding to each of the plurality of the zones according to the image data corresponding to the grayscale data of each of the plurality of zones, and to determine a corresponding ratio according to the level of each of the plurality of zones, so as to determine the turn-on time length of each of the plurality of zones.

7. The liquid crystal display panel as described in claim 6, wherein the ratio is a value smaller than or equal to 1, and larger than 0.

8. An image display method of a liquid crystal display panel, wherein the liquid crystal display panel comprises a liquid crystal display panel, a backlight module, and a control circuit, the image display method comprising:

the control circuit controlling the liquid crystal display panel so as to display a corresponding image according to image data, and controlling the backlight module to provide a backlight to the liquid crystal display panel, comprising:

the control circuit determining a turn-on time point of each of a plurality of zones of the backlight module according to a response time of the liquid crystal display panel and a writing period of at least one target display area of the liquid crystal display panel; and the control circuit also determining a turn-on time length of each of the plurality of zones according to the image data corresponding to grayscale data of each of the plurality of zones, wherein when a luminance of the backlight module is smaller than a specified luminance, the control circuit reduces a size of a central display area of the target display area so as to increase the turn-on time length of the backlight module.

9. The image display method as described in claim 8, wherein the backlight module is a global dimming backlight module, and the image display method further comprises:

the control circuit controlling each of the plurality of zones of the backlight module to be turned on simultaneously, and the control circuit also determining a turn-off time point of the backlight module in each of the plurality of zones according to the image data corresponding to the grayscale data of each of the plurality of zones.

10. The image display method as described in claim 9, further comprising:

the control circuit determining a level corresponding to each of the plurality of zones according to the image data corresponding to the grayscale data of each of the plurality of zones, and determining a corresponding ratio according to the level of each of the plurality of zones, so as to calculate the turn-on time length of each of the plurality of zones according to the ratio.

11. The image display method as described in claim 10, wherein the ratio is a value smaller than or equal to 1, and larger than 0.

12. The image display method as described in claim 8, wherein the backlight module is a local dimming backlight module, the backlight module is divided into a plurality of light-emitting areas along a horizontal scanning direction, and the image display method further comprises:

the control module determining the turn-on time point of each of the plurality of light-emitting areas according to the response time of the liquid crystal display panel and the plurality of writing periods of the plurality of target display areas of the liquid crystal display panel and separates the turn-on time points from each other.

13. The image display method as described in claim 12, wherein each of the plurality of light-emitting areas is divided into the plurality of zones, and the image display method further comprises:

the control circuit determining a level corresponded to each of the plurality of zones according to the image data corresponding to the grayscale data of each of the plurality of zones, and determining a corresponding ratio according to the level of each of the plurality of zones, so as to determine the turn-on time length of each of the plurality of zones according to the ratio.

14. The image display method as described in claim 13, wherein the ratio is a value smaller than or equal to 1, and larger than 0.

* * * * *